US012090605B2

(12) United States Patent
Nakao et al.

(10) Patent No.: US 12,090,605 B2
(45) Date of Patent: Sep. 17, 2024

(54) GLASS FILLER-CONTAINING METAL BOND GRINDING WHEEL

(71) Applicant: NORITAKE CO., LIMITED, Nagoya (JP)

(72) Inventors: Takahiro Nakao, Nagoya (JP); Shoichi Takayama, Nagoya (JP); Takuo Nomura, Nagoya (JP); Yuji Ichinose, Nagoya (JP)

(73) Assignee: NORITAKE CO., LIMITED, Nagoya (JP)

( * ) Notice: Subject to any disclaimer, the term of this patent is extended or adjusted under 35 U.S.C. 154(b) by 560 days.

(21) Appl. No.: 17/433,033

(22) PCT Filed: Feb. 5, 2020

(86) PCT No.: PCT/JP2020/004383

§ 371 (c)(1),
(2) Date: Aug. 23, 2021

(87) PCT Pub. No.: WO2020/175069

PCT Pub. Date: Sep. 3, 2020

(65) Prior Publication Data

US 2022/0161391 A1 May 26, 2022

(30) Foreign Application Priority Data

Feb. 27, 2019 (JP) ..... 2019-034355

(51) Int. Cl.
*B24D 3/10* (2006.01)

(52) U.S. Cl.
CPC ..... *B24D 3/10* (2013.01)

(58) Field of Classification Search
CPC ... B24D 3/10; B24D 3/04; B24D 3/06; B24D 3/02
See application file for complete search history.

(56) References Cited

FOREIGN PATENT DOCUMENTS

| | | | |
|---|---|---|---|
| JP | H05-9859 | U | 2/1993 |
| JP | 2008-229794 | A | 10/2008 |
| JP | 2011-115867 | A | 6/2011 |
| SU | 1066791 | A1 | 1/1984 |

OTHER PUBLICATIONS

International Preliminary Report on Patentability of PCT/JP2020/004383 mailed Aug. 25, 2021, which includes English translation of Written Opinion of the International Searching Authority for PCT/JP2020/004383.
English International Search Report of PCT/JP2020/004383 mailed Mar. 31, 2020.

*Primary Examiner* — Pegah Parvini
(74) *Attorney, Agent, or Firm* — Muncy, Geissler, Olds & Lowe, P.C.

(57) ABSTRACT

A grinding wheel with excellent grinding performance and providing stable grinding over a long period of time is provided. A glass filler-containing metal bond grinding wheel (10) includes a metal bond layer (14) including abrasive grains (11), a metal bond (12), and a glass filler (13). The glass filler-containing metal bond grinding wheel (10) has abrasive grains (11) that are diamonds and/or cubic boron nitrides, the metal bond (12) is a metal containing Cu, the ratio of the glass filler (13) volume to the metal bond (12) volume is 0.025 or more to 1.0 or less, and the metal bond (12) and the glass filler (13) are mutually diffused.

3 Claims, 6 Drawing Sheets

[Fig. 1(a)]
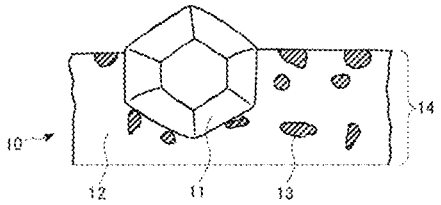
[Fig. 1(b)]
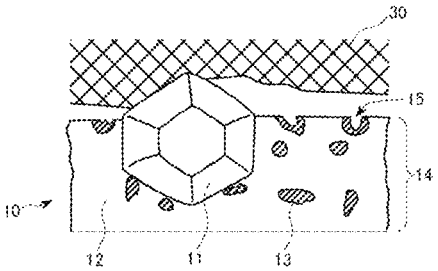

[Fig. 2]
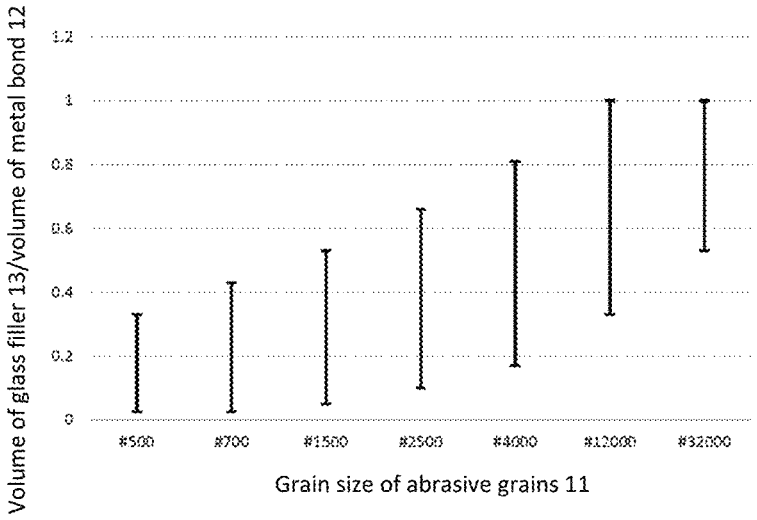

[Fig. 3]
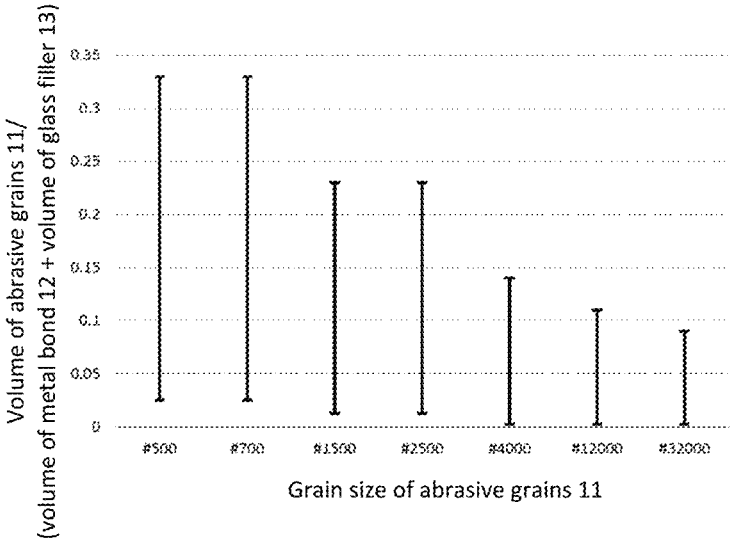
[Fig. 4]
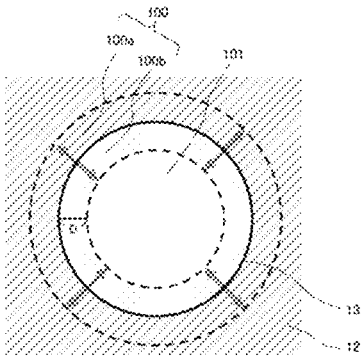

[Fig. 5(a)]
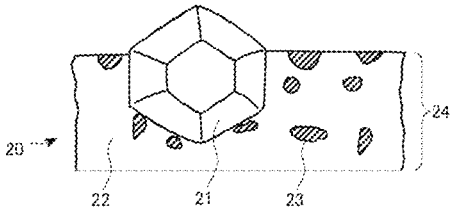
[Fig. 5(b)]
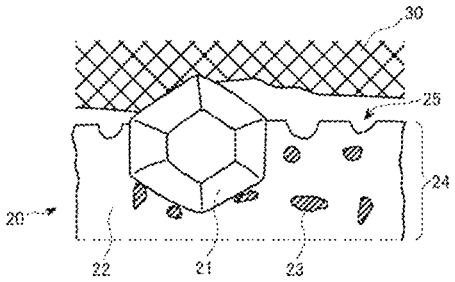

[Fig. 6]
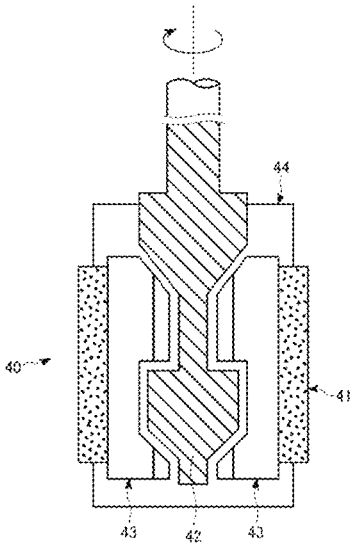
[Fig. 7]
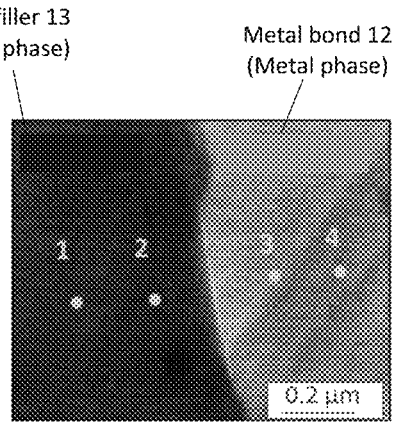
Measurement locations
| | Zr | Cu |
|---|---|---|
| 1 | 89.76 | 10.24 |
| 2 | 86.65 | 13.35 |
| 3 | 74.22 | 25.78 |
| 4 | 22.39 | 77.61 |

[Fig. 8]
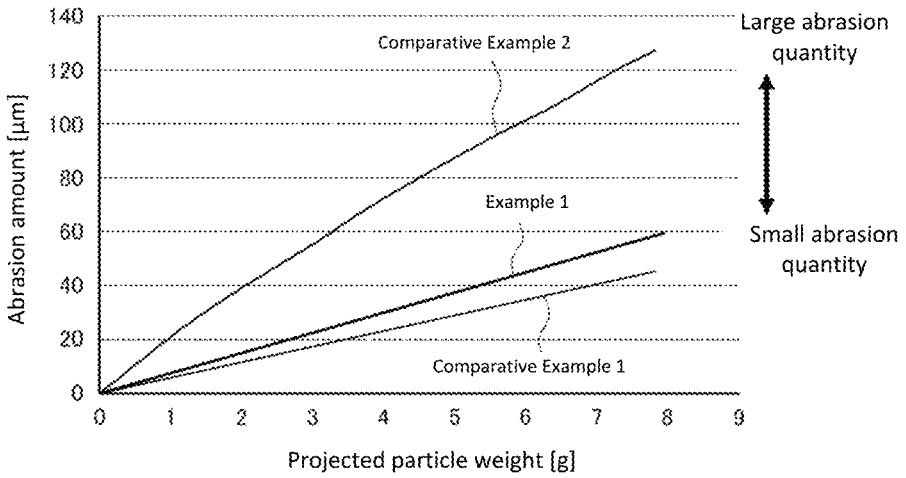

GLASS FILLER-CONTAINING METAL BOND GRINDING WHEEL

TECHNICAL FIELD

The present invention relates to a metal bond grinding wheel containing glass filler.

BACKGROUND ART

The main performance a grinding wheel must provide during grinding processing is stable grinding performance along with a long service life. Grinding performance of the metal bond grinding wheel is usually maintained based on a self-sharpening effect that abrasive grains self-sharpen when the bond for fixing the abrasive grains in place recedes due to cutting scraps and to increased grinding resistance applied to the grinding wheel during grinding. A generally known method for accelerating the self-sharpening effect and suppressing the clogging utilizes a filler such as solid lubricant or glass contained as a constituent element of the grinding wheel.

Patent Literature 1 for example discloses a metal bond grinding wheel characterized in that superabrasives containing diamonds or cubic boron nitrides are combined with hollow spheres made from ceramics or glass by metal bonding. This metal bond grinding wheel can prevent clogging because the rotation balance improves due to a density lowering effect caused by the hollow spheres, and the hollow spheres easily break on a grinding surface and functions as chip pockets.

Patent Literature 2 discloses a superabrasive metal bond grinding wheel where soft abrasive grains containing superabrasives and barium sulfate disperse into a sintering metal bond containing metallic particles and glassy particles, thereby achieving integration by sintering. The superabrasive metal bond grinding wheel acquires abrasion resistance based on a metallic binder and at the same time, bond erosion (erosion breakdown) properties based on glassy components definitely appear at a certain speed due to discharging properties from chips finely ground by barium sulfate. The superabrasive metal bond grinding wheel described above is advantageous because it exhibits a prolonged service life and stable high grindability of the grinding wheel even when used for precise grinding/polishing processing such as honing and superfinishing.

CITATION LIST

Patent Literature

Patent Literature 1: JP H05-9859 U
Patent Literature 2: JP 2008-229794 A

SUMMARY OF INVENTION

Technical Problem

The metal bond grinding wheels of Patent Literatures 1 and 2 lower the degree of binding on the grinding wheels, accelerate self-sharpening, and also the breakage of fillers such as glass and the solid lubricant during the grinding processing to form chip pockets. The chip pockets accelerate the discharge of cutting scraps thereby suppressing clogging and maintaining stable grinding performance.

However, the metal bond grinding wheel of Patent Literature 1 has the following problem. Namely, the grinding wheel contains internal pores, so that the grinding wheel easily wears away and cannot provide a long service life. Moreover, the added hollow spheres (fillers) have low binding force relative to the abrasive grains and metal bond, so that cutting quality declines and shedding (glazing) occurs on the grinding wheel.

The superabrasive metal bond grinding wheel described in Patent Literature 2 also contains glassy particles and soft abrasive grains, and the percentage of bonding members (metallic particles) having excellent abrasion resistance is limited, so that further prolongation of service life reaches its limit.

Particularly, in case of grinding a fine region by using abrasive grains with a small particle diameter, the cutting scraps generated during the processing are tiny and the ability of the cutting scraps to cut away the bonding is small. Therefore, in a grinding wheel used for processing fine regions, the binding strength of the bonds needs to be lowered in order to allow the abrasive grains to self-sharpen and to maintain the grinding performance, so that prolonging the service life is difficult. The above described reasons reveal the need for a grinding wheel having a long service life and providing stable grinding performance especially in regions requiring fine grinding.

Further, when processing fine regions, the modulus of elasticity is preferably increased for achieving the stable grinding performance in order to sufficiently ensure the amount of projection of abrasive grains.

Moreover, recently, there has been market demand for a material having high hardness for engine cylinder bores of a vehicle and a ship. Therefore, the grinding wheel also requires high grindability for honing processing so that the grinding wheel will reciprocate and rotate on inner surfaces of a cylindrical workpieces such as within the engine cylinder bores, to polish and finish the inner surface of the workpiece. The modulus of elasticity is also preferably increased in order to provide high grindability.

However, the metal bond grinding wheel in Patent Literature 2 contains superabrasives and soft abrasive grains so that the modulus of elasticity of the grinding wheel can only be increased to a limited extent.

In view of the aforementioned problems, an object of the present invention is to provide a grinding wheel that has excellent grinding performance and performs stable grinding for a long period of time.

Solution to Problem

A glass filler-containing metal bond grinding wheel of the present invention includes a metal bond layer including abrasive grains, a metal bond, and a glass filler wherein the abrasive grains are diamonds and/or cubic boron nitrides, the metal bond is a metal containing Cu, the ratio of the glass filler volume to the metal bond volume is 0.025 or more to 1.0 or less, and the metal bond and the glass filler are mutually diffused.

As described above, the metal bond and the glass filler are mutually diffused, which improves the binding strength between the metal bond and the glass filler. On the grinding surface on which the grinding wheel acts during the grinding processing, the glass filler gradually abrades away from portions where diffusion of Cu comprising the metal bond does not proceed and forms chip pockets. Further, the grinding wheel strength is not greatly impaired and a drop of sharpness in the cutting due to shedding is suppressed.

Moreover, by setting the ratio of the glass filler volume to the metal bond volume at 0.025 or more to 1.0 or less, it is possible to suppress extreme abrasion and clogging of the grinding wheel. If the glass filler content is too large relative to the metal bond, the abrasion of the grinding wheel becomes greater and the service life of the grinding wheel declines. Further, if the filler content is too small relative to the metal bond, the grinding performance readily drops due to clogging or the like and maintaining stable grinding performance becomes difficult.

Further, the average particle size of the glass filler is preferably 1 μm or larger to less than 3 μm. By using a glass filler having the above particle size, it is possible to achieve a grinding wheel configured with grinding performance that rarely becomes irregular and enabling more stable grinding processing. If the average particle size of the glass filler is too small, the chip pockets are insufficiently formed so that discharging the cutting scraps is difficult. Moreover, if the average particle size of the glass filler is too large, the chip pockets become so large that grinding performance tends to become irregular.

The glass filler also preferably contains one or more elements selected from a group consisting of Zn, Sn, Zr and Ni, and without Pb. A solid solution reaction easily occurs between Zn, Sn, Zr, Ni and Cu as the metal bonds component, and these elements and Cu easily mutually diffuse, so that the glass filler can bond to the metal bond more strongly. Further, while Pb will mutually diffuse with Cu, the use of Pb is not preferable because of its high toxicity and the large environmental burden it creates.

The average particle size of the above abrasive grains is also preferably 35 μm or smaller. The above configuration enables an object for the grinding processing to be finished with a high-quality surface shape and also imparts a long service life to the grinding wheel. Further, too large average particle size of the abrasive grains tends to be disadvantageous from the viewpoint of the duration of the grinding wheel service life.

Advantageous Effects of Invention

The grinding wheel of the present invention has excellent grinding performance and achieves stable grinding for a long period of time.

BRIEF DESCRIPTION OF DRAWINGS

FIG. 1(*a*) is a schematic cross-sectional drawing showing the glass filler-containing metal bond grinding wheel of the present invention. FIG. 1(*b*) is a schematic drawing showing the state of the metal bond layer at the time of the grinding processing when utilizing the glass filler-containing metal bond grinding wheel of the present invention.

FIG. 2 is a drawing showing the suitable ranges of a ratio of the glass filler volume to the metal bond volume in a metal bond layer that are plotted relative to the grain size of the abrasive grains.

FIG. 3 is a drawing showing suitable ranges of a ratio of the grinding wheel volume to the total volume of the metal bond and the glass filler in a metal bond layer plotted relative to the grain size of the abrasive grains.

FIG. 4 is a schematic drawing showing the state of mutual diffusion of the metal bond and the glass filler in a metal bond layer.

FIG. 5(*a*) is a schematic cross-sectional drawing showing a conventional metal bond grinding wheel. FIG. 5(*b*) is a schematic drawing showing the state of a metal bond layer at the time of the grinding processing using a conventional metal bond grinding wheel.

FIG. 6 is a schematic cross-sectional drawing showing the honing processing apparatus.

FIG. 7 shows a SEM image of a fractured surface of the metal bond grinding wheel in Example 1 and measurement results from the ratio of elements of Zr and Cu present at four points in the vicinity of an interfacial region between the glass filler and the metal bond.

FIG. 8 is a drawing showing the amounts of abrasion plotted for projection particle weights in an abrasion resistance test using the metal bond grinding wheel in Example 1 and Comparative Examples 1 and 2.

DESCRIPTION OF EMBODIMENTS

Hereinafter, the embodiments of the present invention will be explained in detail. The following explanation about the components relates to one example (representative example) of the embodiment of the present invention and the following contents do not limit the present invention as long as the essential points of the invention remain unchanged. If the expression "[ . . . ] to [ . . . ]" is used in the present specification, the expression indicates that the numerical values before and after this expression are included.

FIG. 1(*a*) is a schematic cross-sectional drawing showing the glass filler-containing metal bond grinding wheel of the present invention. As shown in FIG. 1(*a*), the glass filler-containing metal bond grinding wheel 10 includes a metal bond layer 14 including abrasive grains 11, a metal bond 12, and a glass filler 13. In the metal bond layer 14, the abrasive grains 11 are bonded to the glass filler 13 by way of the metal bond 12.

In the metal bond layer 14, the metal bond 12 and the glass filler 13 are mutually diffused. Namely, in the metal bond layer 14, there is at least one element (for example, Zr) comprising the glass filler 13 that gradually decreases from the glass filler region to the metal bond region, and there is Cu comprising the metal bond 12 that gradually decreases from the metal bond region to the glass filler region.

The abrasive grains 11 include diamonds or cubic boron nitrides.

Further, the smaller the abrasive grains 11 are, the more with high quality the surface of the object for the grinding processing is finished and the size of the abrasive grains 11 is selected appropriately depending on the required quality of the surface of the object for grinding processing. Meanwhile, if the abrasive grains 11 are too large, the abrasion resistance tends to lower and therefore large grains are not suitable for use in finish processing. To allow using the grinding wheel for finish processing such as honing processing and to have a long service life, the average particle size of the abrasive grains 11 is preferably 35 μm or smaller. Further, as described above, the lower limit of the average particle size of the abrasive grains 11 can be selected depending on the intended purposes and there are no particular restrictions. The lower limit of the average particle size of the abrasive grains 11 can for example be set at 0.2 μm or larger or 1 μm or larger.

The "average particle size" signifies a median size as a particle size equivalent to a 50% particle size accumulated from the fine particle side in the volume-based particle size distribution measured based on laser diffraction and scattering method.

If the gas fillers 13 have an element (in particular a metallic element) capable of mutually diffusing with Cu, there are no particular limitations on their main structure or the like and a structure of any among silica glass, borosilicate glass, borate glass and phosphate glass may be utilized.

As the glass filler 13, a glass filler containing one or more elements selected from a group consisting of Zn, Sn, Zr and Ni is preferably used because they easily mutually diffuse with Cu.

Further, a glass filler not containing Pb is suitable as the glass filler 13 from an environmental aspect.

Here, "Not containing Pb" signifies that there is essentially no Pb (lead) but does not exclude contamination from Pb on a level classified as an impurity. More specifically, the above expression signifies that the Pb in the glass filler is less than 1000 ppm.

In view of the mutual diffusion with Cu and the environmental aspect, glass filler containing one or more elements selected from a group consisting of Zn, Sn, Zr and Ni without Pb are suitable.

A suitable average particle size for the glass filler 13 is 1 μm or larger as the lower limit and 3 μm or smaller as the upper limit. The size of the glass filler 13 can be appropriately selected to obtain a more suitable average particle size in the above range depending on the size of the abrasive grains 11 and the ratio of the metal bond 12 to the glass filler 13, etc.

The metal bond 12 is metal containing Cu. The metal bond 12 preferably contains Cu as a main component and may be binary to quinary alloy. Containing Cu as the main component signifies that the metal bond contains Cu as a component with a largest content (mass %) among components comprising the metal bond. For example, Cu-Sn-based alloy, Cu—Sn—Co-based alloy, Cu—Sn—Co—Fe-based alloy, and Cu—Sn—Ni-based alloy, etc. can be utilized as the metal bond.

In the metal bond layer 14, the ratio of the glass filler 13 volume to the metal bond 12 volume (volume of the glass filler 13/volume of the metal bond 12) is 0.025 to 1.0. The ratio of the glass filler 13 volume to the metal bond 12 volume is preferably adjusted depending on the grain size (average particle size) and the concentration of the abrasive grains 11 in consideration of the intended purpose and grinding conditions.

For example, if the grain size of the abrasive grains 11 is #500 to #800 (average particle size of the abrasive grains 11 of about 20 to 35 μm), the ratio of the glass filler 13 volume to the metal bond 12 volume is preferably 0.025 to 0.5.

If the grain size of the abrasive grains 11 is #1000 to #2000 (average particle size of the abrasive grains 11 of about 8 to 15 μm), the ratio of the glass filler 13 volume to the metal bond 12 volume is preferably 0.05 to 0.7.

If the grain size of the abrasive grains 11 is #2500 to #4000 (average particle size of the abrasive grains 11 of about 3 to 6 μm), the ratio of the glass filler 13 volume to the metal bond 12 volume is preferably 0.1 to 0.9.

If the grain size of the abrasive grains 11 is #6000 or larger (average particle size of the abrasive grains 11 of about 0.2 to 2 μm), the ratio of the glass filler 13 volume to the metal bond 12 volume is preferably 0.2 to 1.

More specific examples of a suitable range of ratios for the glass filler 13 volume to the metal bond 12 volume, at respective grain sizes for the abrasive grains 11 are shown in FIG. 2.

As described above, adjustment is performed so that the smaller the grain size of the abrasive grains 11 is (the greater the numerical value of the grain size of the abrasive grains 11 is), the larger the ratio of the glass filler 13 volume to the metal bond 12 volume, thereby achieving a grinding wheel that performs continuous stable processing without abnormal abrasions occurring on the grinding wheel.

Similar to the ratio of the glass filler 13 volume to the metal bond 12 volume, the ratio of the abrasive grains 11 volume to the total volume of the metal bond 12 and the glass filler 13 (volume of the abrasive grains 11/total volume of the metal bond 12 and the glass filler 13) in the metal bond layer 14 can be adjusted depending on the grain size (average particle size) and the concentration of the abrasive grains 11 in consideration of the intended purpose and the grinding conditions.

For example, if the grain size of the abrasive grains 11 is #500 to #800 (average particle size of the abrasive grains 11 of about 20 to 35 μm), the ratio of the abrasive grains 11 volume to the total volume of the metal bond 12 and the glass filler 13 is more preferably 0.025 to 0.33.

If the grain size of the abrasive grains 11 is #1000 to #3000 (average particle size of the abrasive grains 11 of about 5 to 15 μm), the ratio of the abrasive grains 11 volume to the total volume of the metal bond 12 and the glass filler 13 is more preferably 0.125 to 0.23.

If the grain size of the abrasive grains 11 is #4000 or larger (average particle size of the abrasive grains 11 of about 0.2 to 3 μm), the ratio of the abrasive grains 11 volume to the total volume of the metal bond 12 and the glass filler 13 is more preferably 0.0025 to 0.15.

More specific examples of suitable ranges of the ratio of the abrasive grains 11 volume to the total volumes of the metal bond 12 and the glass filler 13 at the respective grain sizes of the abrasive grains 11 are shown in FIG. 3.

As described above, adjustment is performed so that when the ratio of the volume of the abrasive grains 11 to the total volume of the metal bond 12 and the glass filler 13 is within the range of 0.0025 to 0.33, the smaller the grain size of the abrasive grains 11 (the greater the numerical value of the grain size of the abrasive grains 11), the lower the ratio of the abrasive grains 11 volume to the total volume of the metal bond 12 and the glass filler 13, thereby achieving a grinding wheel that performs continuous stable processing without abnormal abrasions occurring on the grinding wheel.

Further, FIG. 4 shows a state of the mutual diffusion of the metal bond 12 and the glass filler 13 in the metal bond layer 14 of the glass filler-containing metal bond grinding wheel 10. As shown in FIG. 4, a mutual diffusion region 100 formed in the boundary portion between the metal bond 12 and the glass filler 13 comprises a glass component diffusion region 100*a* where at least one element comprising the glass filler 13 diffuses, and a Cu-diffusion region 100*b* where the Cu of the metal bond 12 diffuses. The glass filler 13 comprises a non-diffusion region 101 where Cu does not diffuse and the Cu-diffusion region 100*b* covering the non-diffusion region 101. In the above configuration, the easiness of breaking the glass filler 13 during the grinding processing is respectively different in the Cu-diffusion region and the non-diffusion region, and therefore stable grinding is possible by generating chip pockets while simultaneously suppressing the drop in grinding wheel strength.

The metal bond layer 14 in particular has the mutual diffusion region 100 in the boundary portion between the metal bond 12 and the glass filler 13, and this mutual diffusion region 100 comprises: the glass component diffusion region 100*a* where one or more elements selected from a group consisting of Zn, Sn, Zr and Ni contained in the glass filler 13 diffuse; and the Cu-diffusion region 100*b* where Cu contained in the metal bond 12 diffuses. The non-diffusion region 101 is suitably contained inside the glass filler 13.

A diffusion depth D (thickness of the Cu-diffusion region 100*b*) of Cu is 5% or larger of the average radius of the glass filler 13. Further, the upper limit of the diffusion depth D of Cu only has to be within a range where there is a non-diffusion region 101 inside the glass filler 13. Meanwhile, if the diffusion of Cu is insufficient, the strength of the grinding wheel tends to decrease and its service life shortens. Therefore, the diffusion depth D of Cu is preferably 10% or more of the average radius of the glass filler 13. Further, if the diffusion of Cu is excessive, the glass filler 13 is hard to break, making it difficult to sufficiently acquire the effect from the chip pockets and exhibiting the desired grinding performance tends to become difficult. Therefore, the diffusion depth D of Cu is preferably 60% or less of the average radius of the glass filler 13.

Further, the diffusion depth (the thickness of the glass component diffusion region 100*a*) of the components comprising the glass filler 13 for example, is approximately the same as the diffusion depth of Cu (0.8 to 1.2 times the diffusion depth D of Cu).

In the present invention, the "average radius" signifies a value obtained by dividing the average particle size by 2.

Presence or absence of the mutual diffusion between the metal bond 12 and the glass filler 13 as well as the diffusion depth can be confirmed by analyzing the constituent elements in the vicinity of the boundary region between the metal bond 12 and the glass filler 13 by utilizing EDS elemental analysis.

The state of the glass filler-containing metal bond grinding wheel 10 of the present invention at the time of the grinding processing is described next.

When the grinding processing for the workpiece 30 starts, as shown in FIG. 1(*b*), the grinding surface selectively abrades the glass filler 13 to form the chip pockets 15. The chip pockets 15 play a role in efficiently discharging cutting scraps and suppressing clogging.

At this time, the part where Cu of the metal bond 12 has not diffused is more fragile than the part where Cu has diffused, and the glass filler 13 breaks away from the section where Cu diffusion does not proceed. Therefore, the strength of the grinding wheel is not greatly impaired.

Further, the metal bond 12 and the glass filler 13 are mutually diffused so that the retaining force of the glass filler 13 for retaining the abrasive grains 11 is improved and therefore the shedding is also limited. Moreover, the modulus of elasticity of the grinding wheel 10 can also be enhanced, sinking of the abrasive grains 11 can also be suppressed, and a sufficient amount of projection can be ensured so that sharpness is maintained.

When the grinding processing continues, the tips of the abrasive grains 11 gradually abrade and, at the same time, the metal bond 12 and the glass filler 13 are gradually ground down by the cutting scraps and recede, so that the abrasive grains 11 self-sharpen.

As a result, stable grinding processing can be performed for a long period of time with high grinding performance maintained.

Meanwhile, FIG. 5(*a*) is a schematic cross-sectional drawing showing a conventional metal bond grinding wheel. The conventional metal bond grinding wheel 20 includes abrasive grains 21 and a metal bond layer 24 including a metal bond 22 and graphite (solid lubricant) 23. In the conventional metal bond grinding wheel 20 as shown in FIG. 5(*b*), when the grinding processing for the workpiece 30 starts, the graphite 23 falls out so that the chip pockets 25 are formed. The graphite 23 has a low binding force relative to the abrasive grains 21 and the metal bond 22 and drops out entirely, thus lowering the strength of the grinding wheel 20. The graphite 23 also has a low retaining force for the abrasive grains 21 so that the sharpness or cutting quality tends to readily decline due to the shedding and sinking of the abrasive grains.

The glass filler-containing metal bond grinding wheel 10 of the present invention is suitable for use as a grinding wheel for finish processing and for the grinding processing in fine regions requiring high quality. The glass filler-containing metal bond grinding wheel 10 of the present invention also has stable grinding performance as described above, is a grinding wheel having a long service life and allows continuous grinding to be performed stably for a long period of time. Therefore, the glass filler-containing metal bond grinding wheel 10 is suitable especially for use with no dressing.

More specifically, the glass filler-containing metal bond grinding wheel 10 of the present invention is suitable as a honing grinding wheel for use in honing processing. Particularly, the glass filler-containing metal bond grinding wheel 10 of the present invention is suitable as a honing grinding wheel for grinding processing without needing dressing, because stable high grinding performance can be maintained for a long period of time.

As apparatus for performing the honing processing, for example, as shown in FIG. 6, it is possible to use a honing processing apparatus 40 which comprises: a honing head 44 including honing grinding wheels 41 attached to a plurality of locations along the circumference of the body outer periphery, a tapered cone 42 inserted into the body capable of moving vertically, and a shoe 43 for pressing the honing grinding wheel 41 to an inner surface of the cylinder bore by the descending of the tapered cone 42; and a driving mechanism (not shown in drawing) for rotating and axially moving the honing head 44. The glass filler-containing metal bond grinding wheel 10 of the present invention may also be rendered by the above honing grinding wheel 41 attached to the honing processing apparatus 40.

Next, one example of a method for manufacturing the glass filler-containing metal bond grinding wheel 10 of the present invention is described.

The glass filler-containing metal bond grinding wheel 10 of the present invention can be manufactured by a manufacturing method comprising the steps of: mixing the abrasive grains 11, the glass filler 13, and Cu-containing metal powder to obtain a mixture thereof; filling a molding die with the mixture; and molding the metal bond layer while pressurizing and heating the molding die filled with the mixture as well as mutually diffusing the glass filler 13 and the metal powder to make them react to each other.

In the mixing step, the abrasive grains 11, the glass filler 13 and the metal powder containing Cu are mixed to obtain the mixture.

Alloy powder and mixed powder having a composition corresponding to the configuration of the metal bond 12 can be utilized as the metal powder containing Cu as a raw material used during this step. The abrasive grains 11 and the glass filler 13 are described above.

The volume-based compounding ratio of the raw materials can be adjusted within the range of the metal powder containing Cu, the glass filler=1:1 to 40:1. The volume-based compounding ratio can also be adjusted within the range of the metal powder containing Cu: the abrasive grains=1:1 to 85:1 and 8:1 to 80:1.

The volume-based compounding ratio is also preferably adjusted depending on the grain size (average particle size) or the like of the abrasive grains for use.

In the filling step, the molding die is filled with the mixture obtained in the mixing step. The molding die can be optionally selected depending on the desired shape of the grinding wheel.

In the molding step, after the filling step, the molding die filled with the mixture is heated and pressurized and the metal bond layer 14 is formed while the glass filler 13 and the metal powder are mutually diffused and made to react.

Molding conditions such as a molding temperature, molding pressure and molding time in the molding step can be appropriately adjusted within the range where the glass filler and the metal powder are mutually diffused and made to react, depending on the type of the metal powder containing Cu and the glass filler.

Further, the mutual diffusion and reaction of the glass filler 13 and the metal powder may proceed so that a non-diffusion region remains inside the glass filler 13. However, as described above, if the mutual diffusion is too small, the grinding wheel tends to have lower strength during grinding processing. On the other hand, if the mutual diffusion is too large, the grinding performance of the grinding wheel tends to become lower. Therefore, the molding temperature, the molding pressure and the molding time are adjusted in the molding step to form the metal bond layer 14 so that the glass filler 13 and the metal powder are mutually diffused and made to react, thereby diffusing Cu into a region that is 5% or more of the average radius of the glass filler and more preferably, Cu is diffused into a region that is 10% or more of the glass filler. Further, in diffusion of Cu by mutual diffusion reaction of the glass filler 13 and the metal powder, the molding temperature, molding pressure and molding time can be adjusted so that diffusion of Cu is attained for example in a region 60% or less of the average radius of the glass filler.

For example, since the mutual diffusion and reaction tends to readily proceed, the molding temperature is preferably 350° C. or higher, and more preferably, 400° C. or higher. Further, if the molding temperature is too high, the proceeding of the mutual diffusion and reaction becomes excessive and therefore the molding temperature is preferably 600° C. or lower, and more preferably 500° C. or lower.

Also, the molding pressure is preferably 50 kg/cm$^2$ or higher, and more preferably 100 kg/cm$^2$ or higher. Further, the molding pressure is preferably 500 kg/cm$^2$ or lower and more preferably 300 kg/cm$^2$ or lower.

EXAMPLES

Example 1

A mixture, obtained by mixing a mixed powder of Cu and Sn, diamond abrasive grains (average particle size: 25 μm, #700) and Zr-containing phosphate glass (average particle size: 2.5 μm) at a ratio of 67.5:5:27.5 (volume ratio), is filled into a molding die. Next, the molding processing is performed under the following conditions of a nitrogen atmosphere, 450° C., and 150 kg/cm$^2$ to thereby obtain a metal bond grinding wheel (1) composed of a metal bond layer.

Example 2

A mixture, obtained by mixing a mixed powder of Cu and Sn, diamond abrasive grains (average particle size: 25 μm, #700) and a Zr-containing phosphate glass (average particle size: 2.5 μm) at a ratio of 85:5:10 (volume ratio), is used. Other conditions are identical to those in Example 1, to thereby obtain a metal bond grinding wheel (2).

Comparative Example 1

A mixture, obtained by mixing a mixed powder of Cu and Sn and diamond abrasive grains (average particle size: 25 μm, #700) at a ratio of 95:5 (volume ratio), is used without using phosphate glass. Other conditions are identical to those in Example 1 to thereby obtain a metal bond grinding wheel (3).

Comparative Example 2

Other than using a silicate glass (average particle size: 2.5 μm) instead of the phosphate glass, the conditions are identical to those in Example 1, to thereby obtain a metal bond grinding wheel (4).

The Zr, Sn, Zn and Ni content of the silicate glass used for the Comparative Example 2 were below the detection limits.

Comparative Example 3

Other than using a graphite (average particle size: 2.5 μm) instead of the phosphate glass, the conditions are identical to those in Example 1 to thereby obtain a metal bond grinding wheel (5).

[Evaluation of Grinding Wheels]

The metal bond grinding wheel obtained as described above was bent at 3 points to cause rupturing and the ruptured surface evaluated.

As a result of evaluating the glass filler on the ruptured surface of the metal bond grinding wheel (1) by utilizing EDS elemental analysis, there was a non-diffusion region where Cu was not diffused inside the glass filler.

Further, in the vicinity of the boundary region between the glass filler and the metal bond on the ruptured surface of the metal bond grinding wheel (1), evaluation was performed utilizing EDS elemental analysis. FIG. 7 shows results from measuring and calculating the ratio (mass %) of the Zr and Cu elements at four points in the vicinity of the boundary region between the glass filler and the metal bond of the ruptured surface of the metal bond grinding wheel (1) by utilizing EDS elemental analysis.

As shown in FIG. 7, Zr was also observed near the boundary between the metal bond region and the glass filler in the metal bond, even though the used mixed powder did not contain Zr in the metal bond grinding wheel (1). Further, the ratio of Zr was observed to decrease from the boundary with the glass filler to the inner side of the metal bond region. Further, Cu was also observed near the boundary with the metal bond in the glass filler region even though the used glass filler did not contain Cu, and the ratio of Cu was also observed to decrease from the boundary with the metal bond to the inner side of the glass filler region. These results allow stating that the Cu comprising the metal bond and the Zr comprising the glass filler are at least mutually diffused.

Further, results from utilizing EDS elemental analysis to measure the elements on the abrasive grain surface of the ruptured surface of the metal bond grinding wheel (1) show that C, Cu, Zr and Sn were detected.

The ruptured surface of the metal bond grinding wheel (2) was also evaluated in the same way, and a non-diffusion region was observed inside the glass filler, and the mutual diffusion of Cu and Zr were observed in the vicinity of the boundary region between the glass filler and the metal bond.

Results from evaluating the ruptured surface on the metal bond grinding wheel (4) of the Comparative Example 2 in the same way could not confirm mutual diffusion of the metal bond and the glass filler.

[Abrasion Resistance Test]

On the metal bond grinding wheel (1) (Example 1), the metal bond grinding wheel (3) (Comparative Example 1), and the metal bond grinding wheel (4) (Comparative Example 2), the amount of abrasion (recess depth) was found out when projecting a predetermined amount of hard particles against the above grinding wheels at a fixed projection velocity. FIG. 8 shows results from plotting the weight of the projected hard particles [projected particle weight (g)] and the amount of abrasion (μm) for each projected particle weight respectively to the horizontal axis and the vertical axis.

As shown in FIG. 8, in the metal bond grinding wheel (1) in comparison with the metal bond grinding wheel (4), the abrasion amount of the grinding wheel is greatly reduced and equivalent to that of the metal bond grinding wheel (3). In other words, the metal bond grinding wheel (1) was observed to have a structure that does not greatly impair the strength of the grinding wheel even though containing glass filler.

[Grinding Test Using Grinding Wheel]

An adhesive was utilized to adhere the metal bond grinding wheel (2) (Example 2) to a base metal, thereby achieving a honing grinding wheel. This honing grinding wheel is set in a honing processing apparatus (honing machine having a mechanical expansion system) and the grinding test was conducted under the following conditions.

Number of honing grinding wheels arranged: 6
Grinding wheel peripheral velocity: 95 m/min
Reciprocation velocity: 25 m/min
Grinding fluid: Water-soluble grinding fluid
Workpiece: Equivalent to cast iron FC250 having an 84 mm inner diameter×135 mm height
Processing time: 15 seconds The same grinding test was conducted on the metal bond grinding wheel (5) (Example 3).

The surface of the metal bond grinding wheel (2) after the test was observed by SEM (scanning electron microscope). Results showed that on the metal bond grinding wheel (2), the glass filler abraded selectively for the metal bond to form chip pockets.

Further, according to the results from the EDS mapping, Zr was observed in the recesses. Based on these results the glass filler is assumed to gradually break away in the metal bond grinding wheel (2).

Based on the grinding amount in the workpiece using the metal bond grinding wheel (2) (grindability index: 100%), the grindability indices (%) of the metal bonding grinding wheel (2) and the metal bond grinding wheel (5) were compared. When the grindability index (%) of the metal bond grinding wheel (5) was calculated as a relative value of the metal bond grinding wheel (2) (value obtained by dividing the grinding amount on the workpiece by the metal bonding grinding wheel (5) by the grinding amount on the workpiece by the metal bond grinding wheel (2) and multiplying the divided value by 100), the grindability index (%) of the metal bonding grinding wheel (5) was 96%.

Further, based on the inverse of the abrasion amount of the metal bond grinding wheel (2) (abrasion resistance index: 100%), the abrasion resistance indices (%) of the metal bonding grinding wheel (2) and the metal bond grinding wheel (5) were compared. When the abrasion resistance index (%) of the metal bond grinding wheel (5) was calculated as a relative value of the metal bond grinding wheel (2) (value obtained by dividing the inverse of the abrasion amount of the metal bonding grinding wheel (5) by the inverse of the abrasion amount of the metal bond grinding wheel (2) and multiplying the divided value by 100), the abrasion resistance index (%) of the metal bonding grinding wheel (5) was 65%.

This result reveals that in comparison with the metal bond grinding wheel (5) (conventional grinding wheel), the metal bond grinding wheel (2) has equivalent or greater grinding performance and a drastically improved service life.

Further, during the grinding test, the grinding performance of the metal bond grinding wheel (2) was also stable.

INDUSTRIAL APPLICABILITY

The glass filler-containing metal bond grinding wheel of the present invention can be used for grinding processing on fine regions where high quality is required. The glass filler-containing metal bond grinding wheel can in particular also be used in a no-dressing environment. The above glass filler-containing metal bond grinding wheel can be used widely, for example, for honing processing on the inner surfaces of cylinders of an automobile engine.

REFERENCE SIGNS LIST

10 Glass filler-containing metal bond grinding wheel
11, 12 Abrasive grains
12, 22 Metal bond
13 Glass filler
14, 24 Metal bond layer
15, 25 Chip pocket
20 Conventional metal bond grinding wheel
23 Graphite
30 Workpiece
40 Honing processing apparatus
41 Honing grinding wheel
42 Tapered cone
43 Shoe
44 Honing head
100 Mutual diffusion region
100*a* Glass component diffusion region
100*b* Cu-diffusion region
101 Non-diffusion region

The invention claimed is:

1. A glass filler-containing metal bond grinding wheel comprising a metal bond layer containing abrasive grains, a metal bond, and a glass filler, wherein the abrasive grains are diamonds and/or cubic boron nitrides, the metal bond is a metal containing Cu, the ratio of the glass filler volume to the metal bond volume is 0.025 or more to 1.0 or less, the metal bond and the glass filler are mutually diffused, and the glass filler contains one or more elements selected from a group consisting of Zn, Sn, Zr and Ni and does not contain Pb.

2. The glass filler-containing metal bond grinding wheel according to claim 1, wherein an average particle size of the glass filler is 1 μm or larger to less than 3 μm.

3. The glass filler-containing metal bond grinding wheel according to claim 1, wherein the average particle size of the abrasive grains is 35 μm or smaller.

* * * * *